United States Patent [19]

Turner

[11] Patent Number: 4,499,702

[45] Date of Patent: Feb. 19, 1985

[54] FIVE-TAB STRIP SHINGLES

[75] Inventor: Larry S. Turner, Newark, Ohio

[73] Assignee: Owens-Corning Fiberglas Corporation, Toledo, Ohio

[21] Appl. No.: 334,716

[22] Filed: Dec. 28, 1981

Related U.S. Application Data

[63] Continuation-in-part of Ser. No. 185,032, Sep. 8, 1980, abandoned.

[51] Int. Cl.[3] ..... E04D 1/26; E04D 1/36

[52] U.S. Cl. ..... 52/555; 52/559

[58] Field of Search ..... 52/314, 553–559

[56] References Cited

U.S. PATENT DOCUMENTS

| | | | |
|---|---|---|---|
| 2,171,010 | 8/1939 | Schuetz et al. | 52/559 X |
| 2,199,760 | 5/1940 | Schuetz | 52/559 X |
| 3,407,556 | 10/1968 | Leibrook | 52/559 |
| 3,613,328 | 10/1971 | Morgan et al. | 52/555 |
| 3,927,501 | 12/1975 | Allen et al. | 52/555 |

*Primary Examiner*—J. Karl Bell

*Attorney, Agent, or Firm*—Ronald C. Hudgens; Ted C. Gillespie; Paul J. Rose

[57] ABSTRACT

A set of five-tab strip shingles with rectangular tabs of various widths, any shingle of the set being selectable for production and installable in a plurality on a roof with regular offsets between shingles of different courses without occurrence of objectionable repeating patterns.

7 Claims, 10 Drawing Figures

FIVE-TAB STRIP SHINGLES

RELATED APPLICATION

This is a continuation-in-part of my copending application, Ser. No. 185,032, filed Sept. 8, 1980 now abandoned.

TECHNICAL FIELD

This invention relates generally to asphalt multi-tab strip shingles, and more particularly to five-tab shingles with tabs of different lengths and different widths, a plurality of shingles identical in shape being applicable to a roof, with regular offsets between shingles of adjacent courses, without resulting in objectionable repeating patterns on the roof.

BACKGROUND ART

Prior to my invention, objectionable repeating patterns were limited by the use of strip shingles of two or more different shapes on the same roof. The strip shingles were of complementary shapes, as in U.S. Pat. No. 3,407,556, or there were two pairs of complementary shapes, as in FIGS. 1–4 of U.S. Pat. No. 2,171,010, wherein the tabs on a "right" and a "left" shingle of each pair were arranged in reverse order from each other with respect to the different widths of the tabs, at least some of the tabs on a "right" shingle of one pair had different lengths from corresponding tabs on a "right" shingle of the other pair, and at least some of the tabs on a "left" shingle of one pair had different lengths from corresponding tabs on a "left" shingle of the other pair, which resulted in shingles of four different shapes. Alternatively, shingles of two different non-complementary shapes were used, as in FIGS. 5–7 of the latter patent, wherein the different tab widths of one shingle correspond to the tab widths of the other shingle, but the order of the tabs on one shingle was scrambled from the order of the tabs on the other shingle, rather than being merely reversed as in shingles of complementary shapes. Shingles of different shapes complicated manufacturing, packaging, storing, and shipping and confused roofers.

Objectionable repeating patterns were also limited by using shingles of the same shape, but applying them with irregular offsets between shingles of adjacent courses. The specifying of irregular offsets confused roofers.

DISCLOSURE OF INVENTION

In accordance with the invention, I have provided a set of shingles each having five rectangular tabs of various widths and lengths, the tabs being separated by relatively narrow slots of equal widths. All shingles of the set have the same overall dimensions, but each shingle of the set differs from most other shingles of the set in the widths of the tabs, and from the remaining shingles of the set in the order of tabs of the same widths. I have refrained from including changes in tab widths smaller than 10 mm., in order that the number of different shingles in the set would not be nearly infinite. Thus the nominal width of any tab of any shingle in the set, i.e., the tab width when the slots are considered to be slits of no width, is a whole number multiple of 10 mm., although this would not have to be so.

A characteristic of each hingle in the set is that the maximum nominal tab width, i.e., the tab width when the slots are considered to be slits of no width, is 350 mm., and the minimum nominal tab width is 100 mm.

A further characteristic of any shingle in the set is that it can be selected as the pattern for manufacturing a plurality of identical shingles, and these identical shingles can be applied to a roof in a certain manner with certain results. More particularly, when the identical shingles are applied with the shingles of successive courses offset in the same direction, either continually to the right or continually to the left, by one-fourth the length of a shingle, the following conditions occur:

(a) Above the exposed tabs, the joints between shingles of the lower of any two adjacent courses are covered a nominal distance, i.e., the distance when the slots are considered to be slits of no width, of at least 80 mm. on each side by a tab of a shingle of the upper of the two courses. In other words, the joints are covered on each side an actual distance of at least 80 mm. minus half the width of a slot. If the slots are one-half inch (12.7 mm.) wide, the joints are covered on each side a distance of at least 73.65 (80 minus 6.35) mm., or approximately 3 inches. This is a necessary condition for good wind, rain, and weathering performance.

(b) Any slot in the shingles of any course, including the two "half-slots" between any two shingles, is offset at least 50 mm. from the nearest slot in the shingles of any adjacent course. This is a necessary condition for good wind, rain, and weathering performance as well as for good appearance.

(c) Any slot in the shingles of any course, including the two "half-slots" between any two shingles, is offset at least 20 mm. from the nearest slot in the shingles of any second course away.

(d) Any slot in the shingles of any course, including the two "half-slots" between any two shingles, is offset at least 20 mm. from the nearest sot in the shingles of any third course away.

By the use of the invention, a plurality of identically shaped five-tab shingles with random-width tabs, as opposed to shingles of two or more different shapes, can be applied to a roof with regular offsets between shingles of adjacent courses, without objectionable repeating patterns on the roof.

BRIEF DESCRIPTION OF THE DRAWINGS

The invention is described with respect to the accompanying drawings in which.

BEST MODE OF CARRYING OUT INVENTION

Figure 1:
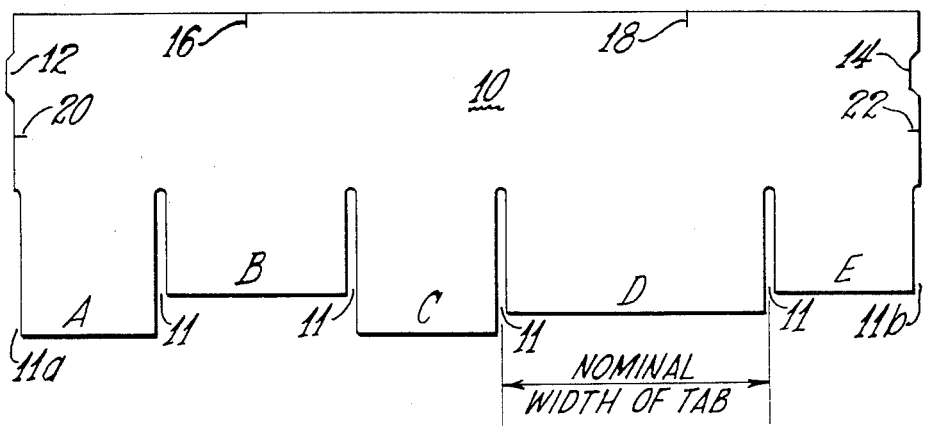
FIG. 1 is a plan view of a five-tab strip shingle constructed in accordance with the invention.

With respect to the drawings, FIG. 1 shows a five-tab strip shingle 10 constructed in accordance with the invention and having five tabs A, B, C, D, and E of random lengths and widths. The tabs are separated by slots 11 of uniform width, with "half-slots" 11*a* and 11*b* being provided as cutouts respectively at the outer edges of the tabs A and E. As shown, the left-hand end of the body portion of the shingle 10 above the tab A is provided with an aligning tab 12 and the right-hand end above the tab E is provided with a corresponding aligning notch 14. At an upper edge, the body portion is slit respectively at 16 and 18 to designate one-quarter and three-quarter points along the length. At opposite edges, the body portion of the shingle 10 is slit respectively at 20 and 22 to designate points for alignment with the top edge of shingles in a previously installed course.

The shingle 10 is one meter long, neglecting the tab 12. The tabs A, B, C, D and E have nominal widths, i.e., the tab widths when the slots are considered to be slits of no width, of 160, 200, 170, 300, and 170 mm., respectively. The slots 11 should be no wider than one inch and preferably are about one-half inch (12.7 mm.) wide. The body of the shingle 10, from the top edge to the beginning of the slots 11, is 179.83 mm. wide. The tabs A and C are of a long length, 165.74 mm. The tab D is of a medium length, 147.39 mm. The tabs B and E are of a short length, 129.03 mm.

Figure 2:
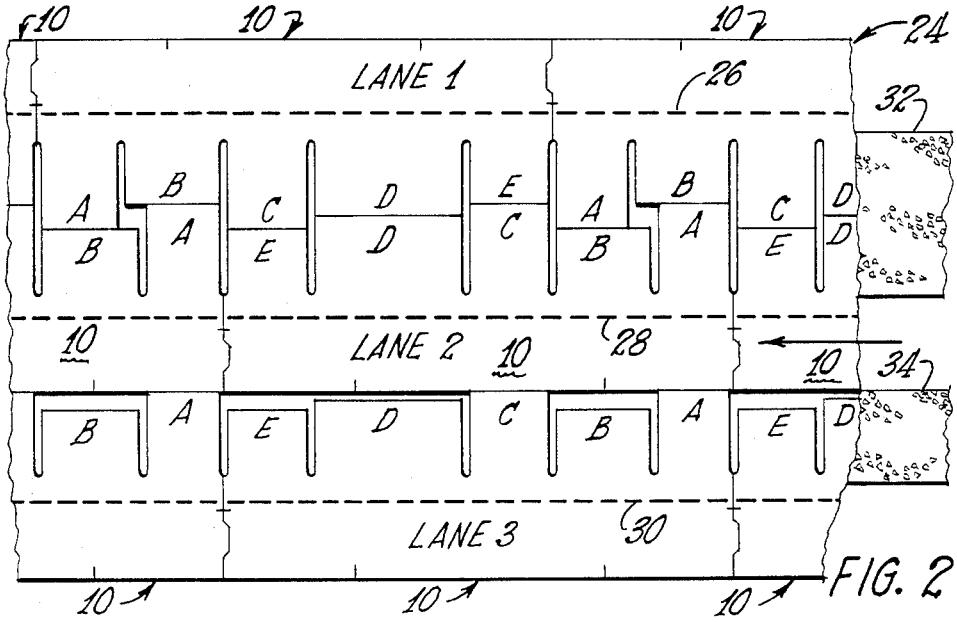
FIG. 2 is a fragmentary plan view of a sheet of shingle material illustrating the pattern for cutting shingles like that of FIG. 1 in each of three lanes.

FIG. 2 shows the cutting pattern on a sheet 24 of shingle material for three lanes 1, 2, and 3 of shingles 10 with the tabs of the shingles in lane 1 abutting the tabs of the shingles in lane 2, the shingles of both lanes being identical rather than those of one lane being "mirror images" of those of the other lane. The tab D on a shingle in lane 1 abuts the tab D on a shingle in lane 2, and the shingles in one lane are staggered from those in the other. The tabs C and E have equal widths and each long tab C on a shingles in one of the two lanes abuts a short tab E on another shingle in the other of the two lanes. The tabs C, D, and E of one shingle respectively abut the tabs E, D, and C of another shingle, these being the only common points of abutment between the two shingles. Further, the tabs A and B of one shingle respectively abut the tabs B and A of another shingle, these being the only common points of abutment between those two shingles. More specifically, a first shingle in one lane of lanes 1 and 2 abuts a second and a third shingle in the other lane of lanes 1 and 2, the tabs A and B of the first shingle respectively abutting tabs B and A of the second shingle and the tabs C, D, and E of the first shingle respectively abutting tabs E, D, and C of the third shingle.

FIG. 2 also shows a third lane 3 because the sheet 24 of shingle material is normally made in a width which will accommodate three lanes of the shingles 10. The shingles 10 of lane 3 have their tab portions A and C in abutment with the body portions of the respective shingles 10 of lane 2. As shown, the shingles of lane 3 are aligned respectively with the shingles of lane 2, but this is not required.

The sheet 24 of shingle material is one meter wide. The shingles 10 are one meter long excluding the tab 12. The sots between tabs of the shingles 10 are 12.7 millimeters wide. The actual widths of the tabs A, B, C, D, and E are 147.3, 187.3, 157.3, 287.3, and 157.3 millimeters, respectively, the widths of tabs C and E being equal. The body portion of a shingle 10 is 179.83 mm. wide, from the upper edge to the slots. The lengths of the tabs A, B, C, D, and E are 165.74, 129.03, 165.74, 147.39 and 129.03 mm., respectively. It will be seen that the width of the sheet 24 is three body widths plus two tab A lengths plus one tab B length. This is $(3\times179.83)+(2\times165.74)+129.03$, or 1000 mm. The slits 20 and 22 are preferably 129.03 mm. from the upper edge of a shingle 10.

The sheet 24 of shingle material is preferably made of asphalt impregnated fibrous glass mat covered on a shingle top side with granules of crushed rock on the portions of the shingles which would be exposed on a roof and with less expensive granules on the portions of the shingles which would be concealed on a roof. Solar activated adhesive is applied over the granules along the lines 26, 28, and 30. Preferably a shingle bottom side of the sheet 24 is covered on the tab portions of the shingles 10 with black expanded polystyrene beads as indicated by bead strips 32 and 34 and as more fully explained in U.S. Pat. No. 4,188,763.

Figure 3:
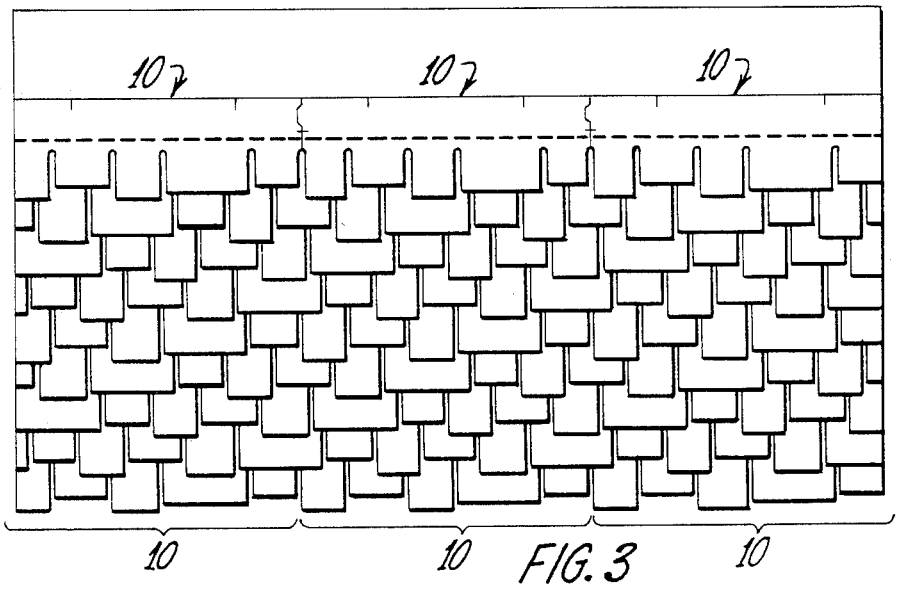
FIG. 3 is a fragmentary plan view of a roof having shingles like that of FIG. 1 installed thereon.

FIG. 3 shows a fragmentary plan view of a roof shingled with a plurality of the shingles 10, the shingles of successive courses being offset to the right by one-fourth the length of a shingle 10.

Figure 4:
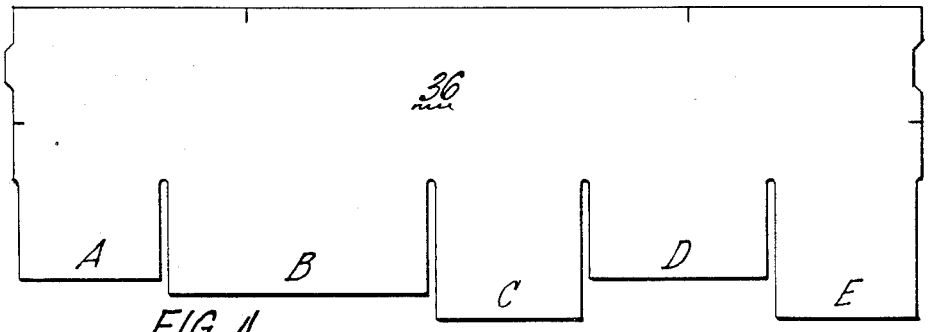
FIG. 4 is an alternative embodiment of the shingle of FIG. 1.

FIG. 4 shows a shingle 36 like the shingle 10 of FIG. 1, but with the tabs A, B, C, D, and E in the reverse order. The plan of shingle 36 is obtainable by flipping the shingle 10 of FIG. 1 over end for end, but retaining the original position of the tab 12 and notch 14.

Figure 5:
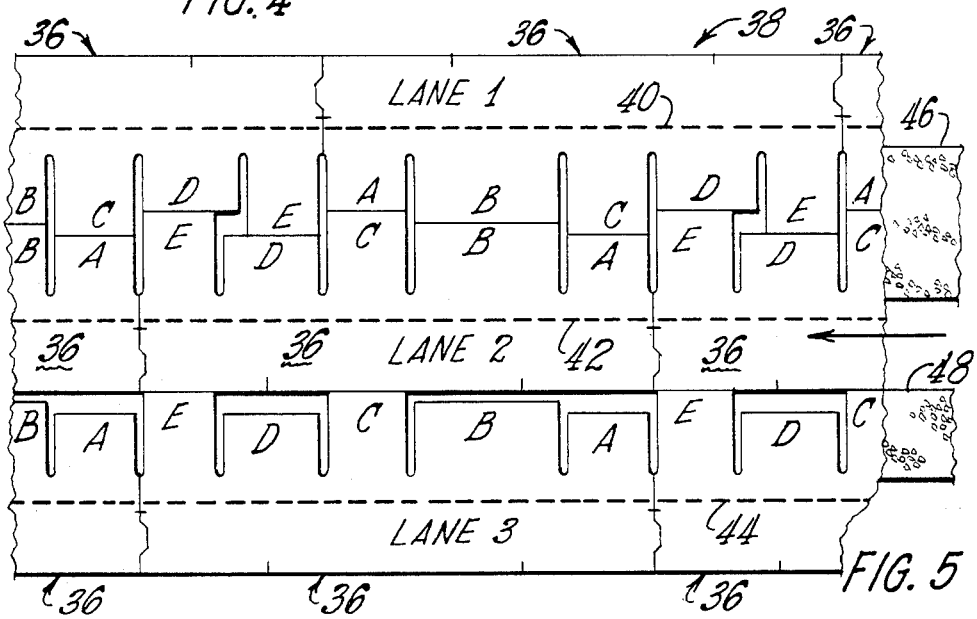
FIG. 5 is a view similar to FIG. 2, but showing the cutting pattern for the shingle of FIG. 4.

FIG. 5 shows the cutting pattern on a sheet 38 of shingle material for three lanes of shingles 36 such as shown in FIG. 4. The shingles 36 in the three lanes are identical. Lines 40, 42, and 44 indicate where solar activated adhesive is applied. The sheet 38 has strips 46 and 48 of black expanded polystyrene beads under the shingle tabs.

Figure 6:
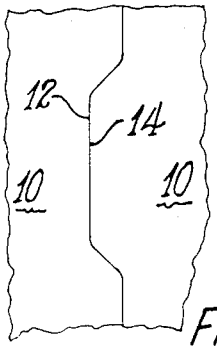
FIG. 6 is an enlarged fragmentary plan view showing a portion of the cutting pattern between two shingles.

FIG. 6 shows a tab 12 on one shingle 10 and a notch 14 on another shingle 10. The tab 12 and notch 14 preferably have rounded corners as shown in FIG. 6. Shingles 36 preferably are similarly formed with rounded corners on the aligning tab and notch.

Figure 7:
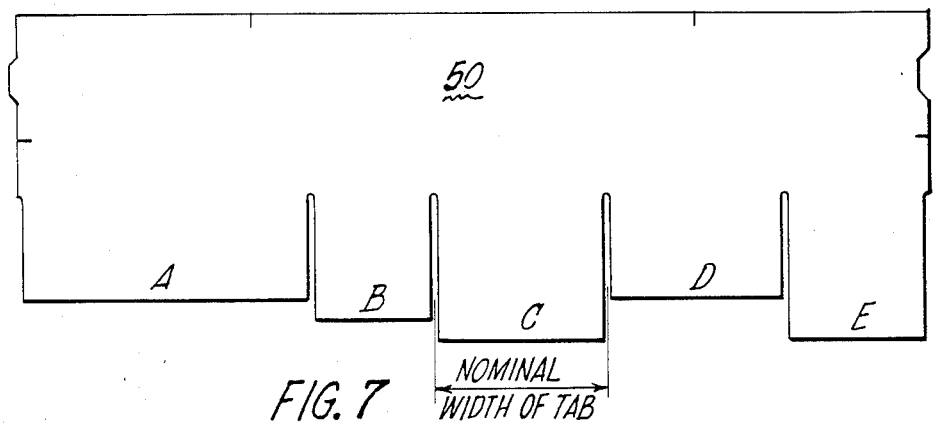
FIGS. 7 and 9 are plan views of other five-tab strip shingles constructed in accordance with the invention.

FIG. 7 shows a shingle 50 identical to the shingle 10 of FIG. 1 except for the size of the tabs. The tabs A, B, C, D, and E of the shingle 50 have nominal widths of 330, 130, 190, 200 and 150 mm., respectively, the tabs C and E being of the long length, the tab B being of the medium length, and the tabs A and D being of the short length.

Figure 8:
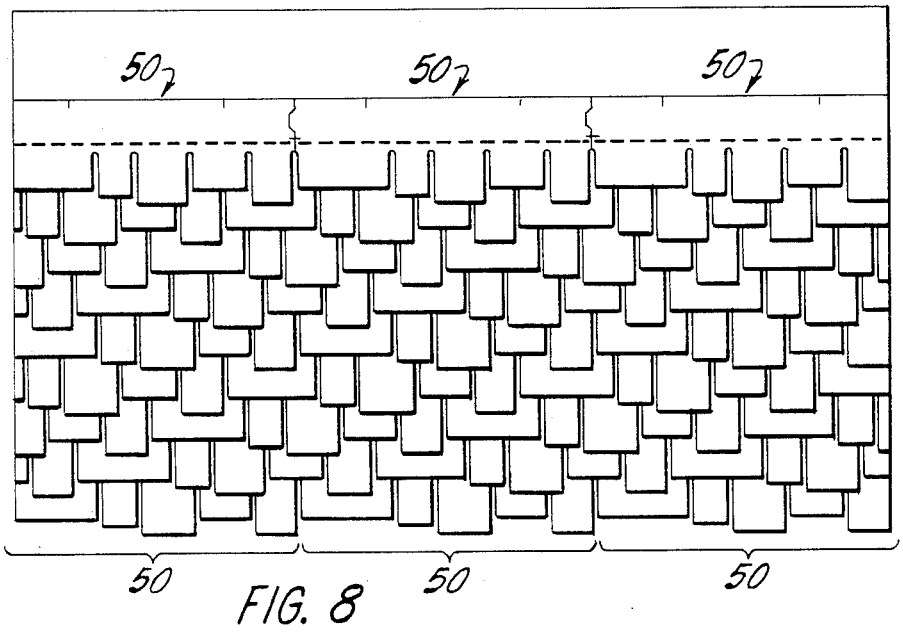
FIGS. 8 and 10 are fragmentary plan views of roofs having shingles respectively like those of FIGS. 7 and 9 installed thereon.

FIG. 8 shows a fragmentary plan view of a roof shingled with a plurality of the shingles 50, the shingles of successive courses being offset to the right by one-fourth the length of a shingle 50.

Figure 9:
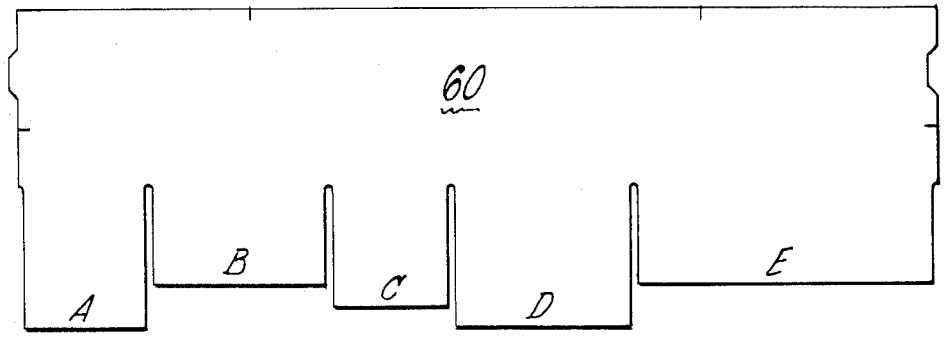

FIG. 9 shows a shingle 60 identical to the shingle 10 of FIG. 1 except for the size of the tabs. The tabs A, B, C, D and E of the shingle 60 have nominal widths of 140, 200, 130, 200 and 330 mm., respectively, the tabs A and D being of the long length, the tab C being of the medium length, and the tabs D and E being of the short length.

Figure 10:
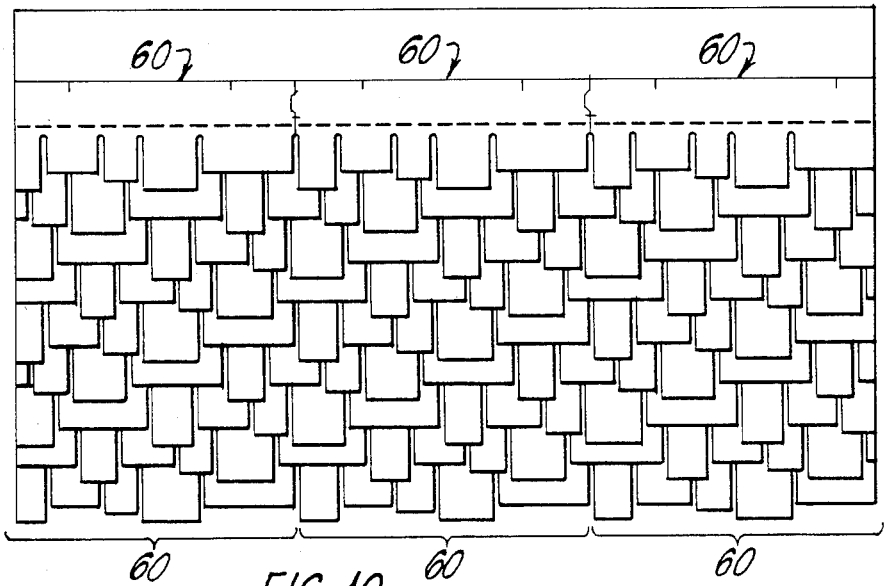

FIG. 10 shows a fragmentary plan view of a roof shingled with a plurality of the shingles 60, the shingles of successive courses being offset to the right by one-fourth the length of a shingle 60.

It will be seen that for the shingles 10, 36, 50 and 60, the maximum nominal tab width is 330 mm., which occurs in tab A of shingle 50 and tab E of shingle 60, and the minimum nominal tab width is 130 mm., which occurs in tab B of shingle 50 and tab C of shingle 60.

For the shingle 10, considering the slots to be slits of no width, a joint under the one-quarter length point would be covered on one side by 90 mm. of the tab B and on the other side by 110 mm. of the tab B. A joint under the three-quarter length point would be covered on one side by 80 mm. of the tab D and on the other side by 220 mm. of the tab D.

For the shingle 50, considering the slots to be slits of no width, a joint under the one-quarter length point would be covered on one side by 250 mm. of the tab A and on the other side by 80 mm. of the tab A. A joint under the three-quarter length point would be covered on one side by 100 mm. of the tab D and on the other side by 100 mm. of the tab D.

For the shingle 60, considering the slots to be slits of no width, a joint under the one-quarter length point would be covered on one side by 110 mm. of the tab B and on the other side by 90 mm. of the tab B. A joint under the three-quarter length point would be covered on one side by 250 mm. of the tab E and on the other side by 80 mm. of the tab E.

In FIGS. 3, 8, and 10, any slot in one course of shingles is offset at least 50 mm. from the nearest slot in an adjacent course, at least 20 mm. from the nearest slot in a second course away, and at least 20 mm. from the nearest slot in a third course away.

The shingles 10, 36, 50, and 60 are exemplary. Following is a list of five-tab shingles giving nominal tab widths in mm for each of the tabs A, B, C, D, and E. Each of these shingles, when installed in a plurality on a roof with one-quarter shingle length offsets in the same direction between successive courses, will result in the nominal 80 mm. minimum coverage at joints, the 50 mm. minimum offset between slots in adjacent courses, the 20 mm. minimum offset between slots in courses one course apart, and the 20 mm. minimum offset between slots in courses two courses apart.

| | Nominal Tab Widths In mm. | | | | |
|---|---|---|---|---|---|
| Shingle No. | Tab A | Tab B | Tab C | Tab D | Tab E |
| 1. | 350 | 100 | 100 | 100 | 350 |
| 2. | 130 | 320 | 100 | 100 | 350 |
| 3. | 140 | 320 | 100 | 100 | 340 |
| 4. | 150 | 320 | 100 | 100 | 330 |
| 5. | 120 | 330 | 100 | 100 | 350 |
| 6. | 130 | 330 | 100 | 100 | 340 |
| 7. | 140 | 330 | 100 | 100 | 330 |
| 8. | 110 | 340 | 100 | 100 | 350 |
| 9. | 120 | 340 | 100 | 100 | 340 |
| 10. | 130 | 340 | 100 | 100 | 330 |
| 11. | 100 | 350 | 100 | 100 | 350 |
| 12. | 110 | 250 | 100 | 100 | 340 |
| 13. | 120 | 350 | 100 | 100 | 330 |
| 14. | 170 | 180 | 200 | 100 | 350 |
| 15. | 170 | 180 | 190 | 110 | 350 |
| 16. | 170 | 170 | 200 | 110 | 350 |
| 17. | 170 | 180 | 180 | 120 | 350 |
| 18. | 170 | 170 | 190 | 120 | 350 |
| 19. | 170 | 160 | 200 | 120 | 350 |
| 20. | 130 | 200 | 200 | 120 | 350 |
| 21. | 140 | 200 | 200 | 120 | 340 |
| 22. | 150 | 200 | 200 | 120 | 330 |
| 23. | 170 | 180 | 170 | 130 | 350 |
| 24. | 170 | 170 | 180 | 130 | 350 |
| 25. | 170 | 160 | 190 | 130 | 350 |
| 26. | 130 | 200 | 190 | 130 | 350 |
| 27. | 140 | 200 | 190 | 130 | 340 |
| 28. | 150 | 200 | 190 | 130 | 330 |
| 29. | 140 | 190 | 200 | 130 | 340 |
| 30. | 150 | 190 | 200 | 130 | 330 |
| 31. | 130 | 200 | 200 | 130 | 340 |

-continued

| | Nominal Tab Widths In mm. | | | | |
|---|---|---|---|---|---|
| Shingle No. | Tab A | Tab B | Tab C | Tab D | Tab E |
| 32. | 140 | 200 | 200 | 130 | 330 |
| 33. | 140 | 200 | 180 | 140 | 340 |
| 34. | 150 | 200 | 180 | 140 | 330 |
| 35. | 140 | 190 | 190 | 140 | 340 |
| 36. | 150 | 190 | 190 | 140 | 330 |
| 37. | 130 | 200 | 190 | 140 | 340 |
| 38. | 140 | 200 | 190 | 140 | 330 |
| 39. | 150 | 180 | 200 | 140 | 330 |
| 40. | 140 | 190 | 200 | 140 | 330 |
| 41. | 130 | 200 | 200 | 140 | 330 |
| 42. | 150 | 200 | 170 | 150 | 330 |
| 43. | 150 | 190 | 180 | 150 | 330 |
| 44. | 140 | 200 | 180 | 150 | 330 |
| 45. | 150 | 180 | 190 | 150 | 330 |
| 46. | 140 | 190 | 190 | 150 | 330 |
| 47. | 130 | 200 | 190 | 150 | 330 |
| 48. | 350 | 180 | 140 | 160 | 170 |
| 49. | 350 | 170 | 150 | 160 | 170 |
| 50. | 350 | 130 | 190 | 160 | 170 |
| 51. | 150 | 330 | 190 | 160 | 170 |
| 52. | 140 | 340 | 190 | 160 | 170 |
| 53. | 130 | 350 | 190 | 160 | 170 |
| 54. | 350 | 120 | 200 | 160 | 170 |
| 55. | 150 | 320 | 200 | 160 | 170 |
| 56. | 140 | 330 | 200 | 160 | 170 |
| 57. | 130 | 340 | 200 | 160 | 170 |
| 58. | 150 | 200 | 320 | 160 | 170 |
| 59. | 170 | 180 | 130 | 170 | 350 |
| 60. | 350 | 180 | 130 | 170 | 170 |
| 61. | 170 | 170 | 140 | 170 | 350 |
| 62. | 350 | 170 | 140 | 170 | 170 |
| 63. | 170 | 160 | 150 | 170 | 350 |
| 64. | 130 | 200 | 150 | 170 | 350 |
| 65. | 350 | 130 | 180 | 170 | 170 |
| 66. | 140 | 340 | 180 | 170 | 170 |
| 67. | 130 | 350 | 180 | 170 | 170 |
| 68. | 350 | 120 | 190 | 170 | 170 |
| 69. | 140 | 330 | 190 | 170 | 170 |
| 70. | 150 | 330 | 190 | 170 | 160 |
| 71. | 130 | 340 | 190 | 170 | 170 |
| 72. | 140 | 340 | 190 | 170 | 160 |
| 73. | 350 | 110 | 200 | 170 | 170 |
| 74. | 140 | 320 | 200 | 170 | 170 |
| 75. | 150 | 320 | 200 | 170 | 160 |
| 76. | 130 | 330 | 200 | 170 | 170 |
| 77. | 140 | 330 | 200 | 170 | 160 |
| 78. | 170 | 180 | 120 | 180 | 350 |
| 79. | 350 | 180 | 120 | 180 | 170 |
| 80. | 170 | 170 | 130 | 180 | 350 |
| 81. | 350 | 170 | 130 | 180 | 170 |
| 82. | 170 | 350 | 130 | 180 | 170 |
| 83. | 170 | 160 | 140 | 180 | 350 |
| 84. | 130 | 200 | 140 | 180 | 350 |
| 85. | 140 | 200 | 140 | 180 | 340 |
| 86. | 330 | 200 | 140 | 180 | 150 |
| 87. | 140 | 190 | 150 | 180 | 340 |
| 88. | 330 | 190 | 150 | 180 | 150 |
| 89 | 130 | 200 | 150 | 180 | 340 |
| 90. | 350 | 130 | 170 | 180 | 170 |
| 91. | 170 | 310 | 170 | 180 | 170 |
| 92. | 130 | 350 | 170 | 180 | 170 |
| 93. | 350 | 120 | 180 | 180 | 170 |
| 94. | 170 | 300 | 180 | 180 | 170 |
| 95. | 130 | 340 | 180 | 180 | 170 |
| 96. | 140 | 340 | 180 | 180 | 160 |
| 97. | 350 | 110 | 190 | 180 | 170 |
| 98. | 330 | 150 | 190 | 180 | 150 |
| 99. | 130 | 330 | 190 | 180 | 170 |
| 100. | 140 | 330 | 190 | 180 | 160 |
| 101. | 150 | 330 | 190 | 180 | 150 |
| 102. | 350 | 100 | 200 | 180 | 170 |
| 103. | 330 | 140 | 200 | 180 | 150 |
| 104. | 130 | 320 | 200 | 180 | 170 |
| 105. | 140 | 320 | 200 | 180 | 160 |
| 106. | 150 | 320 | 200 | 180 | 150 |
| 107. | 170 | 180 | 300 | 180 | 170 |
| 108 | 150 | 180 | 340 | 180 | 150 |
| 109. | 170 | 350 | 120 | 190 | 170 |
| 110. | 130 | 200 | 130 | 190 | 350 |

-continued

| Shingle No. | Nominal Tab Widths In mm. Tab A | Tab B | Tab C | Tab D | Tab E |
|---|---|---|---|---|---|
| 111. | 140 | 200 | 130 | 190 | 340 |
| 112. | 150 | 200 | 130 | 190 | 330 |
| 113. | 330 | 200 | 130 | 190 | 150 |
| 114. | 340 | 200 | 130 | 190 | 140 |
| 115. | 170 | 350 | 130 | 190 | 160 |
| 116. | 140 | 190 | 140 | 190 | 340 |
| 117. | 150 | 190 | 140 | 190 | 330 |
| 118. | 330 | 190 | 140 | 190 | 150 |
| 119. | 340 | 190 | 140 | 190 | 140 |
| 120. | 130 | 200 | 140 | 190 | 340 |
| 121. | 140 | 200 | 140 | 190 | 330 |
| 122. | 330 | 200 | 140 | 190 | 140 |
| 123. | 150 | 180 | 150 | 190 | 330 |
| 124. | 340 | 180 | 150 | 190 | 140 |
| 125. | 140 | 190 | 150 | 190 | 330 |
| 126. | 330 | 190 | 150 | 190 | 140 |
| 127. | 130 | 200 | 150 | 190 | 330 |
| 128. | 170 | 310 | 160 | 190 | 170 |
| 129. | 160 | 320 | 160 | 190 | 170 |
| 130. | 170 | 300 | 170 | 190 | 170 |
| 131. | 160 | 310 | 170 | 190 | 170 |
| 132. | 170 | 310 | 170 | 190 | 160 |
| 133. | 330 | 150 | 180 | 190 | 150 |
| 134. | 160 | 300 | 180 | 190 | 170 |
| 135. | 170 | 300 | 180 | 190 | 160 |
| 136. | 330 | 140 | 190 | 190 | 150 |
| 137. | 340 | 140 | 190 | 190 | 140 |
| 138. | 330 | 150 | 190 | 190 | 140 |
| 139. | 330 | 130 | 200 | 190 | 150 |
| 140. | 340 | 130 | 200 | 190 | 140 |
| 141. | 330 | 140 | 200 | 190 | 140 |
| 142. | 170 | 350 | 110 | 200 | 170 |
| 143. | 130 | 200 | 120 | 200 | 350 |
| 144. | 140 | 200 | 120 | 200 | 340 |
| 145. | 150 | 200 | 120 | 200 | 330 |
| 146. | 330 | 200 | 120 | 200 | 150 |
| 147. | 340 | 200 | 120 | 200 | 140 |
| 148. | 350 | 200 | 120 | 200 | 130 |
| 149. | 170 | 350 | 120 | 200 | 160 |
| 150. | 140 | 190 | 130 | 200 | 340 |
| 151. | 150 | 190 | 130 | 200 | 330 |
| 152. | 330 | 190 | 130 | 200 | 150 |
| 153. | 340 | 190 | 130 | 200 | 140 |
| 154. | 350 | 190 | 130 | 200 | 130 |
| 155. | 130 | 200 | 130 | 200 | 340 |
| 156. | 140 | 200 | 130 | 200 | 330 |
| 157. | 330 | 200 | 130 | 200 | 140 |
| 158. | 340 | 200 | 130 | 200 | 130 |
| 159. | 170 | 350 | 130 | 200 | 150 |
| 160. | 150 | 180 | 140 | 200 | 330 |
| 161. | 340 | 180 | 140 | 200 | 140 |
| 162. | 350 | 180 | 140 | 200 | 130 |
| 163. | 140 | 190 | 140 | 200 | 330 |
| 164. | 330 | 190 | 140 | 200 | 140 |
| 165. | 340 | 190 | 140 | 200 | 130 |
| 166. | 130 | 200 | 140 | 200 | 330 |
| 167. | 330 | 200 | 140 | 200 | 130 |
| 168. | 350 | 170 | 150 | 200 | 130 |
| 169. | 340 | 180 | 150 | 200 | 130 |
| 170. | 330 | 190 | 150 | 200 | 130 |
| 171. | 170 | 310 | 150 | 200 | 170 |
| 172. | 160 | 320 | 150 | 200 | 170 |
| 173. | 150 | 330 | 150 | 200 | 170 |
| 174. | 170 | 300 | 160 | 200 | 170 |
| 175. | 160 | 310 | 160 | 200 | 170 |
| 176. | 170 | 310 | 160 | 200 | 160 |
| 177. | 150 | 320 | 160 | 200 | 170 |
| 178. | 160 | 320 | 160 | 200 | 160 |
| 179. | 330 | 150 | 170 | 200 | 150 |
| 180. | 160 | 300 | 170 | 200 | 170 |
| 181. | 170 | 300 | 170 | 200 | 160 |
| 182. | 150 | 310 | 170 | 200 | 170 |
| 183. | 160 | 310 | 170 | 200 | 160 |
| 184. | 170 | 310 | 170 | 200 | 150 |
| 185. | 330 | 140 | 180 | 200 | 150 |
| 186. | 340 | 140 | 180 | 200 | 140 |
| 187. | 330 | 150 | 180 | 200 | 140 |
| 188. | 150 | 300 | 180 | 200 | 170 |
| 189. | 160 | 300 | 180 | 200 | 160 |

-continued

| Shingle No. | Nominal Tab Widths In mm. Tab A | Tab B | Tab C | Tab D | Tab E |
|---|---|---|---|---|---|
| 190. | 170 | 300 | 180 | 200 | 150 |
| 191. | 330 | 130 | 190 | 200 | 150 |
| 192. | 340 | 130 | 190 | 200 | 140 |
| 193. | 350 | 130 | 190 | 200 | 130 |
| 194. | 330 | 140 | 190 | 200 | 140 |
| 195. | 340 | 140 | 190 | 200 | 130 |
| 196. | 330 | 150 | 190 | 200 | 130 |
| 197. | 330 | 120 | 200 | 200 | 150 |
| 198. | 340 | 120 | 200 | 200 | 140 |
| 199. | 350 | 120 | 200 | 200 | 130 |
| 200. | 330 | 130 | 200 | 200 | 140 |
| 201. | 340 | 130 | 200 | 200 | 130 |
| 202. | 330 | 140 | 200 | 200 | 130 |
| 203. | 170 | 160 | 320 | 200 | 150 |
| 204. | 130 | 300 | 100 | 300 | 170 |
| 205. | 140 | 300 | 100 | 300 | 160 |
| 206. | 150 | 300 | 100 | 300 | 150 |
| 207. | 160 | 300 | 100 | 300 | 140 |
| 208. | 170 | 300 | 100 | 300 | 130 |
| 209. | 170 | 200 | 160 | 300 | 170 |
| 210. | 170 | 190 | 170 | 300 | 170 |
| 211. | 160 | 200 | 170 | 300 | 170 |
| 212. | 170 | 200 | 170 | 300 | 160 |
| 213. | 170 | 180 | 180 | 300 | 170 |
| 214. | 160 | 190 | 180 | 300 | 170 |
| 215. | 170 | 190 | 180 | 300 | 160 |
| 216. | 150 | 200 | 180 | 300 | 170 |
| 217. | 160 | 200 | 180 | 300 | 160 |
| 218. | 170 | 200 | 180 | 300 | 150 |
| 219. | 170 | 200 | 150 | 310 | 170 |
| 220. | 170 | 190 | 160 | 310 | 170 |
| 221. | 160 | 200 | 160 | 310 | 170 |
| 222. | 170 | 200 | 160 | 310 | 160 |
| 223. | 170 | 180 | 170 | 310 | 170 |
| 224. | 160 | 190 | 170 | 310 | 170 |
| 225. | 170 | 190 | 170 | 310 | 160 |
| 226. | 150 | 200 | 170 | 310 | 170 |
| 227. | 160 | 200 | 170 | 310 | 160 |
| 228. | 170 | 200 | 170 | 310 | 150 |
| 229. | 330 | 100 | 100 | 320 | 150 |
| 230. | 340 | 100 | 100 | 320 | 140 |
| 231. | 350 | 100 | 100 | 320 | 130 |
| 232. | 100 | 350 | 130 | 320 | 100 |
| 233. | 100 | 340 | 140 | 320 | 100 |
| 234. | 170 | 200 | 150 | 320 | 160 |
| 235. | 100 | 330 | 150 | 320 | 100 |
| 236. | 170 | 190 | 160 | 320 | 160 |
| 237. | 160 | 200 | 160 | 320 | 160 |
| 238. | 170 | 200 | 160 | 320 | 150 |
| 239. | 100 | 320 | 160 | 320 | 100 |
| 240. | 170 | 160 | 200 | 320 | 150 |
| 241. | 160 | 170 | 200 | 320 | 150 |
| 242. | 170 | 170 | 200 | 320 | 140 |
| 243. | 150 | 180 | 200 | 320 | 150 |
| 244. | 160 | 180 | 200 | 320 | 140 |
| 245. | 170 | 180 | 200 | 320 | 130 |
| 246. | 330 | 100 | 100 | 330 | 140 |
| 247. | 340 | 100 | 100 | 330 | 130 |
| 248. | 350 | 100 | 100 | 330 | 120 |
| 249. | 100 | 350 | 120 | 330 | 100 |
| 250. | 100 | 340 | 130 | 330 | 100 |
| 251. | 100 | 330 | 140 | 330 | 100 |
| 252. | 170 | 200 | 150 | 330 | 150 |
| 253. | 100 | 320 | 150 | 330 | 100 |
| 254. | 170 | 160 | 190 | 330 | 150 |
| 255. | 160 | 170 | 190 | 330 | 150 |
| 256. | 170 | 170 | 190 | 330 | 140 |
| 257. | 150 | 180 | 190 | 330 | 150 |
| 258. | 160 | 180 | 190 | 330 | 140 |
| 259. | 170 | 180 | 190 | 330 | 130 |
| 260. | 170 | 160 | 200 | 330 | 140 |
| 261. | 160 | 170 | 200 | 330 | 140 |
| 262. | 170 | 170 | 200 | 330 | 130 |
| 263. | 330 | 100 | 100 | 340 | 130 |
| 264. | 340 | 100 | 100 | 340 | 120 |
| 265. | 350 | 100 | 100 | 340 | 110 |
| 266. | 100 | 350 | 110 | 340 | 100 |
| 267. | 100 | 340 | 120 | 340 | 100 |
| 268. | 100 | 330 | 130 | 340 | 100 |

-continued

| Shingle No. | Nominal Tab Widths In mm. | | | | |
|---|---|---|---|---|---|
| | Tab A | Tab B | Tab C | Tab D | Tab E |
| 269. | 100 | 320 | 140 | 340 | 100 |
| 270. | 170 | 170 | 180 | 340 | 140 |
| 271. | 160 | 180 | 180 | 340 | 140 |
| 272. | 170 | 180 | 180 | 340 | 130 |
| 273. | 170 | 160 | 190 | 340 | 140 |
| 274. | 160 | 170 | 190 | 340 | 140 |
| 275. | 170 | 170 | 190 | 340 | 130 |
| 276. | 170 | 160 | 200 | 340 | 130 |
| 277. | 330 | 100 | 100 | 350 | 120 |
| 278. | 340 | 100 | 100 | 350 | 110 |
| 279. | 350 | 100 | 100 | 350 | 100 |
| 280. | 100 | 350 | 100 | 350 | 100 |
| 281. | 170 | 200 | 110 | 350 | 170 |
| 282. | 100 | 340 | 110 | 350 | 100 |
| 283. | 170 | 190 | 120 | 350 | 170 |
| 284. | 160 | 200 | 120 | 350 | 170 |
| 285. | 100 | 330 | 120 | 350 | 100 |
| 286. | 170 | 180 | 130 | 350 | 170 |
| 287. | 160 | 190 | 130 | 350 | 170 |
| 288. | 150 | 200 | 130 | 350 | 170 |
| 289. | 100 | 320 | 130 | 350 | 100 |
| 290. | 170 | 180 | 170 | 350 | 130 |
| 291. | 170 | 170 | 180 | 350 | 130 |
| 292. | 170 | 160 | 190 | 350 | 130 |

The shingles 10, 36, 50, and 60 are the shingles numbered 211, 181, 191, and 156, respectively, in the list.

Any of the shingles in the list can be chosen for production, given three different tab lengths, and installed in a plurality on a roof with regular offsets of one-fourth the length of a shingle in the same direction between successive courses while providing a nominal minimum of 80 mm. coverage on each side of a joint between shingles in one course by a tab of a shingle in the succeeding course, a minimum of 50 mm. offset between slots in adjacent courses, a minimum of 20 mm. offset between slots in courses one course apart, and a minimum of 20 mm. offset between slots in courses two courses apart, thereby providing a roof with a random shingled appearance.

In the appended claims, the "nominal width" of a tab is the width the tab would have if the slots were slits of no width, and is equal to the actual width of the tab plus the widths of two half-slots respectively on opposite sides. The "nominal distance" on each side of a shingle joint in one course covered by a tab of a shingle in a succeeding course is the distance the covering tab would extend from the joint if the slots were slits of no width, and is equal to the distance from the joint to a side edge of the covering tab plus half the width of a slot.

Various modifications may be made in the shingles described without departing from the spirit and scope of the invention.

I claim:

1. A cutting pattern for strip shingles all identical in shape and each having five rectangular tabs of various lengths and widths, each tab having one of three different lengths definable as short, long, and intermediate, one end tab and a middle tab of the five tabs having equal widths, the middle tab being of the long length, said one end tab being of the short length, and a tab between said middle tab and said one end tab being of the intermediate length, the cutting pattern having three lanes of the strip shingles on a sheet of shingle material, the tabs on the shingles in each of two of the lanes extending into abutting relationship with the tabs on the shingles in the other of the two lanes, and the equal-width tabs on each shingle in one of the two lanes respectively abutting the equal-width tabs on a shingle in the other of the two lanes with the middle tab on each shingle abutting the equal-width end tab on the other shingle along the full widths of the tabs.

2. A strip shingle having five rectangular tabs of various widths separated by slots of equal widths, two end tabs being partially defined by cut-outs or half-slots each of a width equal to half the width of a slot between two tabs whereby a joint between two shingles defines an equivalent slot, each tab having a nominal width within the range of ten to thirty-five percent, inclusive, of the length of the shingle, and the actual widths of the respective tabs being such that when a plurality of identically shaped shingles are installed on a roof with one-quarter shingle length offsets in the same direction between successive courses, (a) the joint between any two shingles in a lower of any two adjacent courses is covered by a tab of a shingle in an upper of the two adjacent courses, the joint-covering tab extending on each side of the joint a nominal distance of at least eight percent of the length of the shingle, (b) the center line of any slot of any shingle or of any equivalent slot between two shingles in one of any two adjacent courses is offset a distance of at least five percent of the length of a shingle from the center line of the nearest slot or equivalent slot of shingles in the other of the two adjacent courses, (c) the center line of any slot of any shingle or of any equivalent slot between two shingles of any one course is offset a distance of at least two percent of the length of a shingle from the center line of the nearest slot or equivalent slot of shingles in any second course away from the one course, and (d) the center line of any slot of any shingle or of any equivalent slot between two shingles of any one course is offset a distance of at least two percent of the length of a shingle from the center line of the nearest slot or equivalent slot of shingles in any third course away from the one course.

3. A strip shingle as claimed in claim 2 wherein each tab has one of three different lengths, there being two tabs of one of the lengths, two tabs of another of the lengths, and one tab of the third length.

4. A strip shingle as claimed in claim 3 wherein any two tabs of the same length are separated by at least one tab of a different length.

5. A roof shingled with a plurality of identically shaped strip shingles and having one-quarter shingle length offsets in the same direction between successive courses, each shingle having five rectangular tabs of various widths separated by slots of equal widths, two end tabs of each shingle being partially defined by cut-outs or half-slots each of a width equal to half the width of a slot between two tabs whereby a joint between two shingles defines an equivalent slot, each tab of a shingle having a nominal width within the range of ten to thirty-five percent, inclusive, of the length of the shingle, and the actual widths of the respective tabs of each shingle being such that (a) the joint between any two shingles in a lower of any two adjacent courses is covered by a tab of a shingle in an upper of the two adjacent courses, the joint-covering tab extending on each side of the joint a nominal distance of at least eight percent of the length of the shingle, (b) the center line of any slot of any shingle or of any equivalent slot between two shingles in one of any two adjacent courses is offset a distance of at least five percent of the length of a shingle from the center line of the nearest slot or equivalent slot of shingles in the other of the two adjacent courses, (c) the center line of any slot of any shingle or of any equivalent slot between two shingles of any one course is offset a distance of at least two percent of the length of a shingle from the center line of the nearest slot or equivalent slot of shingles in any second course away from the one course, and (d) the center line of any slot of any shingle or of any equivalent slot between two shingles of any one course is offset a distance of at least two percent of the length of a shingle from the center line of the nearest slot or equivalent slot of shingles in any third course away from the one course.

6. A shingled roof as claimed in claim 5 wherein each tab of a shingle has one of three different lengths, there being two tabs of one of the lengths, two tabs of another of the lengths, and one tab of the third length.

7. A shingled roof as claimed in claim 6 wherein any two tabs of a shingle having the same length are separated by at least one tab of a different length.

* * * * *